US010422546B2

(12) United States Patent
Suhara et al.

(10) Patent No.: US 10,422,546 B2
(45) Date of Patent: Sep. 24, 2019

(54) AIR CONDITIONER

(71) Applicant: DAIKIN INDUSTRIES, LTD., Osaka-shi, Osaka (JP)

(72) Inventors: Ryouta Suhara, Osaka (JP); Nobuyuki Kojima, Osaka (JP); Natsumi Furo, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/009,921

(22) Filed: Jun. 15, 2018

(65) Prior Publication Data

US 2018/0299164 A1 Oct. 18, 2018

Related U.S. Application Data

(63) Continuation of application No. PCT/JP2016/083858, filed on Nov. 15, 2016.

(30) Foreign Application Priority Data

Dec. 18, 2015 (JP) ..... 2015-247074

(51) Int. Cl.
*F24F 11/76* (2018.01)
*F24F 11/89* (2018.01)
(Continued)

(52) U.S. Cl.
CPC ..... *F24F 11/76* (2018.01); *F24F 11/61* (2018.01); *F24F 11/65* (2018.01); *F24F 11/79* (2018.01);
(Continued)

(58) Field of Classification Search
CPC ..... F24F 11/0001; F24F 11/70; F24F 11/72; F24F 11/74; F24F 11/77; F24F 11/80; F24F 11/83
(Continued)

(56) References Cited

U.S. PATENT DOCUMENTS 4,909,310 A * 3/1990 Umemura ..... F24F 1/0007 165/300
5,073,204 A * 12/1991 Herwander ..... B08B 15/026 134/21
(Continued)

FOREIGN PATENT DOCUMENTS

JP 62-010539 A 1/1987
JP 62-147257 A 7/1987
(Continued)

OTHER PUBLICATIONS

International Search Report (PCT/ISA/210) issued in PCT/JP2016/083858, dated Feb. 21, 2017.
(Continued)

*Primary Examiner* — Steven B McAllister
*Assistant Examiner* — Ko-Wei Lin
(74) *Attorney, Agent, or Firm* — Birch, Stewart, Kolasch & Birch, LLP

(57) ABSTRACT

Entrance of cold air from near a wall of an indoor space is avoided. An airflow direction adjusting flap is provided at a main outlet opening of the casing, and changes a direction of air supplied from the main outlet opening in a vertical direction. The heat exchange temperature sensor detects a temperature of the indoor heat exchanger. A motor controller controls the airflow direction adjusting flap to operate in an airflow mode, in which air is supplied from the main outlet opening at least horizontally, when a value detected by the heat exchange temperature sensor is greater than a first predetermined value in the heating operation.

8 Claims, 10 Drawing Sheets

(51) Int. Cl.

| | |
|---|---|
| ***F24F 11/79*** | (2018.01) |
| ***F24F 11/65*** | (2018.01) |
| ***F24F 11/61*** | (2018.01) |
| *F24F 13/14* | (2006.01) |
| *F24F 140/50* | (2018.01) |

(52) U.S. Cl.
CPC ..... *F24F 11/89* (2018.01); *F24F 13/1413* (2013.01); *F24F 2140/50* (2018.01); *F24F 2221/54* (2013.01)

(58) Field of Classification Search
USPC ..... 454/239, 241, 248, 251
See application file for complete search history.

(56) References Cited

U.S. PATENT DOCUMENTS

2008/0237361 A1* 10/2008 Wang ..... H05K 7/20727 236/49.3
2012/0097748 A1* 4/2012 Kanaya ..... F24F 1/0014 236/49.3
2014/0026604 A1* 1/2014 Yoshimura ..... F25D 29/00 62/180
2014/0090408 A1* 4/2014 Norrell ..... F24F 11/30 62/187

FOREIGN PATENT DOCUMENTS

JP 3369331 B2 4/1996
JP 2004-316957 A 11/2004
JP 2005-147512 A 6/2005
JP 2013-181671 A 9/2013

OTHER PUBLICATIONS

Extended European Search Report dated May 16, 2019 in corresponding European Patent Application No. 16875319.2.

* cited by examiner (A) KNOWN INDOOR UNIT (B) EMBODIMENT OF PRESENT INVENTION

AIR CONDITIONER

CROSS-REFERENCE TO RELATED APPLICATIONS

This is a continuation of International Application No. PCT/JP2016/083858 filed on Nov. 15, 2016, which claims priority to Japanese Patent Application No. 2015-247074 filed on Dec. 18, 2015. The entire disclosures of these applications are incorporated by reference herein.

TECHNICAL FIELD

The present invention relates to an air conditioner having an indoor unit which supplies air into an indoor space.

BACKGROUND ART

Air conditioners, such as one disclosed in Patent Document 1, have been known. The air conditioner disclosed in Patent Document 1 includes an indoor unit installed near a ceiling. The indoor unit has an indoor heat exchanger (i.e., a heat exchanger). According to Patent Document 1, when a temperature of the indoor heat exchanger is lower than a predetermined value during a heating operation, air is supplied in a horizontal direction to prevent not-yet-warmed air from blowing directly on a person in a room, that is, to prevent a cold draft. Further, according to Patent Document 1, when the temperature of the indoor heat exchanger is higher than a predetermined value, air is supplied downward so that warmed air (or warm air) is delivered to the feet of the person in the room.

CITATION LIST

Patent Document

Patent Document 1: Japanese Unexamined Patent Publication No. 2013-181671

SUMMARY

The present disclosure is directed to an air conditioner having an indoor unit (10) which supplies air to an indoor space (500). The air conditioner includes: an indoor casing (20) provided with an outlet opening (24*a* to 24*d*); an airflow direction adjusting flap (51) which is provided at the outlet opening (24*a* to 24*d*) and changes a direction of air supplied from the outlet opening (24*a* to 24*d*) in a vertical direction; an indoor heat exchanger (32) which is provided in the indoor casing (20) and heats the air by a refrigerant before the air is supplied from the outlet opening (24*a* to 24*d*) in a heating operation; a first temperature detector (61) which detects a temperature of the indoor heat exchanger (32) or a temperature of the air supplied from the outlet opening (24*a* to 24*d*); and a controller (72) comprised of a processor and a memory storing a program which, when executed by the processor, performs a process of controlling the airflow direction adjusting flap (51) to operate in an airflow mode, in which the air is supplied from the outlet opening (24*a* to 24*d*) at least horizontally, when a value detected by the first temperature detector (61) is greater than a first predetermined value in the heating operation. The process increases an amount of air supplied from the outlet opening (24*a* to 24*d*) in the airflow mode from an amount of air supplied from the outlet opening (24*a* to 24*d*) when the value detected by the first temperature detector (61) in the heating operation is smaller than the first predetermined value.

The air conditioner changes its operational mode for the heating operation to the airflow mode when a temperature of the indoor heat exchanger (32) or a temperature of supplied air is greater than the first predetermined value in the heating operation. In the airflow mode, warmed air (or warm air) is supplied from the outlet openings (24*a* to 24*d*) at least in the horizontal direction. Thus, the warm air can reach the vicinity of the wall of the indoor space (500), and blocks the cold air from coming into the indoor space (500) from near the wall. Entrance of cold air into the indoor space (500) from near the wall is avoided in this manner. Consequently, the difference in temperature between a central portion and a peripheral portion (near the wall) of the indoor space (500) becomes small. Further, the warm air flows along the wall of the indoor space (500) and therefore wraps around the whole of the indoor space (500).

Further, because the amount of air supplied from the outlet opening mode is increased when the value detected by the first temperature detector (61) is smaller than the first predetermined value, during the heating operation in the airflow mode, the warm air can reach the vicinity of the wall of the indoor space (500) more easily. Entrance of cold air into the indoor space (500) from near the wall can be avoided more reliably.

Note that the "increase in the amount of air" during the operation in the airflow mode refers to a state in which an amount of air supplied from any one of a plurality of outlet openings (if there are a plurality of outlet openings) increases from an amount of air supplied when the value detected by the first temperature detector (61) is smaller than the first predetermined value.

Advantages

According to the present disclosure, warm air blocks the cold air from coming into the indoor space (500) from near the wall. Entrance of cold air into the indoor space (500) from near the wall can be avoided in this manner. Consequently, the difference in temperature between a central portion and a peripheral portion (near the wall) of the indoor space (500) becomes small. Further, the warm air flows along the wall of the indoor space (500) and therefore wraps around the whole of the indoor space (500).

Further, entrance of cold air into the indoor space (500) from near the wall can be avoided more reliably.

DESCRIPTION OF EMBODIMENTS

An embodiment of the present invention will now be described in detail with reference to the drawings. The embodiment described below is merely an exemplary one in nature, and is not intended to limit the scope, applications, or use of the invention.

Embodiment

—Configuration of Air Conditioner—

Figure 1:
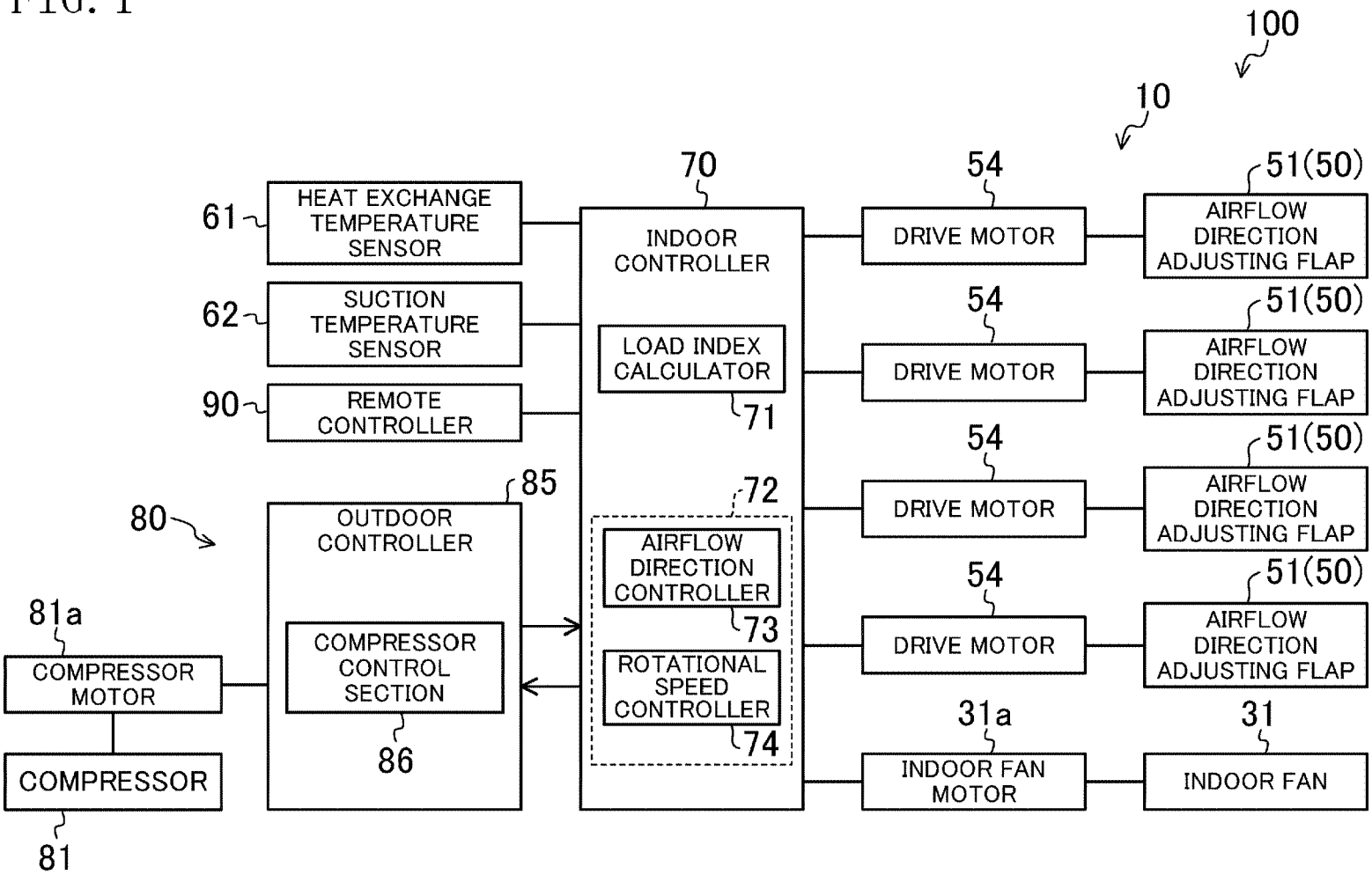
FIG. 1 is a block diagram schematically illustrating an indoor controller and devices connected to the indoor controller according to an embodiment.

As illustrated in FIG. 1, an air conditioner (100) of the present embodiment includes an indoor unit (10), an outdoor unit (80), and a remote controller (90).

Although not shown, the indoor unit (10) and the outdoor unit (80) are connected to each other by a communication pipe, thereby forming a refrigerant circuit in which a refrigerant circulates to perform a refrigeration cycle. Further, the indoor unit (10) and the outdoor unit (80) are electrically connected by wire, allowing an indoor controller (70) included in the indoor unit (10) and an outdoor controller (85) included in the outdoor unit (80) to communicate to each other. The remote controller (90) is connected to the indoor controller (70) such that wired or wireless communication can be established with the indoor controller (70).

Figure 2:
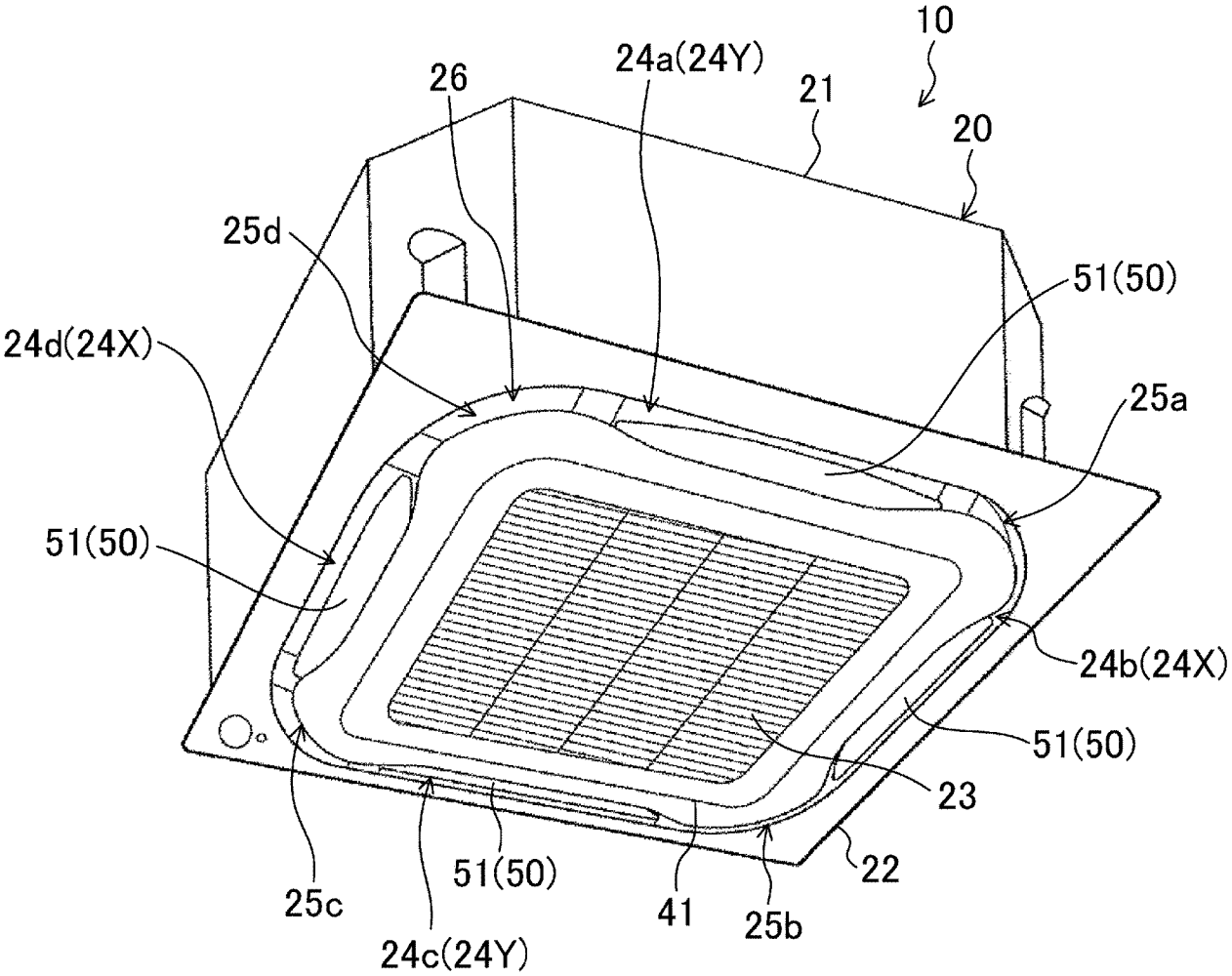
FIG. 2 is a diagram illustrating a perspective view of an indoor unit viewed obliquely from below.

As illustrated in FIG. 2, the indoor unit (10) is configured as a ceiling embedded type, and supplies air to the indoor space (500). A configuration of the indoor unit (10) will be described later.

The outdoor unit (80) is installed outside the indoor space (500), such as outdoors. As illustrated in FIG. 1, the outdoor unit (80) has a compressor (81) which compresses a refrigerant, a compressor motor (81*a*) which drives the compressor (81), and an outdoor controller (85). The outdoor controller (85) is configured as a microcomputer including a CPU and a ROM, and functions as a compressor control section (86) which controls an operational frequency of the compressor (81).

The remote controller (90) is attached, for example, to a wall (502) of the indoor space (500), and receives an instruction from a person in the room. That is, the person in the room can adjust various settings of the air conditioner (100) and give operating instructions via the remote controller (90). The remote controller (90) which has received a setting instruction or an operating instruction sends the instruction to the indoor controller (70).

In particular, the remote controller (90) is configured to be able to receive a setting that allows transition to an airflow mode, described later, and a setting that does not allow transition to the airflow mode.

—Configuration of Indoor Unit—

As illustrated in FIGS. 1 to 5, the indoor unit (10) has a casing (20) (which corresponds to an indoor casing), an indoor fan (31), an indoor heat exchanger (32), a drain pan (33), a bell mouth (36), an airflow direction adjusting flap (51), a heat exchange temperature sensor (61) (which corresponds to a first temperature detector), a suction temperature sensor (62) (which corresponds to a second temperature detector), and an indoor controller (70).

<Casing>

The casing (20) is provided on a ceiling (501) of an indoor space (500). The casing (20) is comprised of a casing body (21) and a decorative panel (22). The casing (20) houses the indoor fan (31), the indoor heat exchanger (32), the drain pan (33), and the bell mouth (36).

The casing body (21) is mounted by being inserted in an opening in the ceiling (501) of the indoor space (500). The casing body (21) has a generally rectangular parallelepiped box-like shape with its lower end open. The casing body (21) has approximately a flat top panel (21*a*) and a side panel (21*b*) projecting down from a peripheral portion of the top panel (21*a*).

<Indoor Fan>

Figure 4:
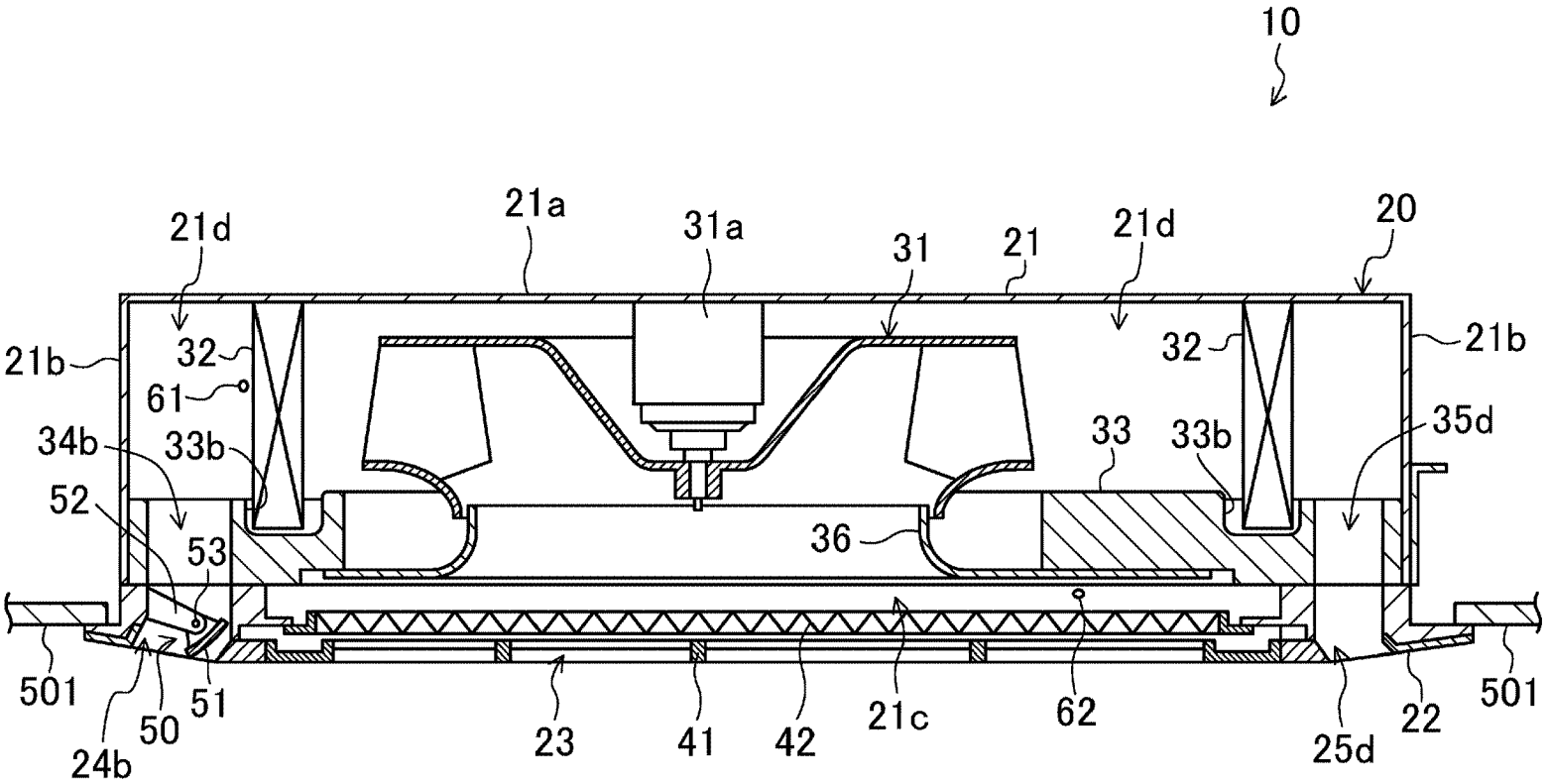
FIG. 4 is a diagram generally illustrating a cross-sectional view of the indoor unit taken along the line III-O-III shown in FIG. 3.

As illustrated in FIG. 4, the indoor fan (31) is a centrifugal blower which draws air from below and expels the air radially outward. The indoor fan (31) is arranged at the center in the casing body (21). The indoor fan (31) is driven by an indoor fan motor (31*a*). The indoor fan motor (31*a*) is fixed to a central portion of the top panel (21*a*).

<Bell Mouth>

The bell mouth (36) is arranged below the indoor fan (31). The bell mouth (36) guides the air which has flowed in the casing (20) to the indoor fan (31). The bell mouth (36) and the drain pan (33) divide the internal space of the casing (20) into a primary space (21*c*) located on a suction side of the indoor fan (31) and a secondary space (21*d*) located on an air-blowing side of the indoor fan (31).

<Indoor Heat Exchanger>

Figure 3:
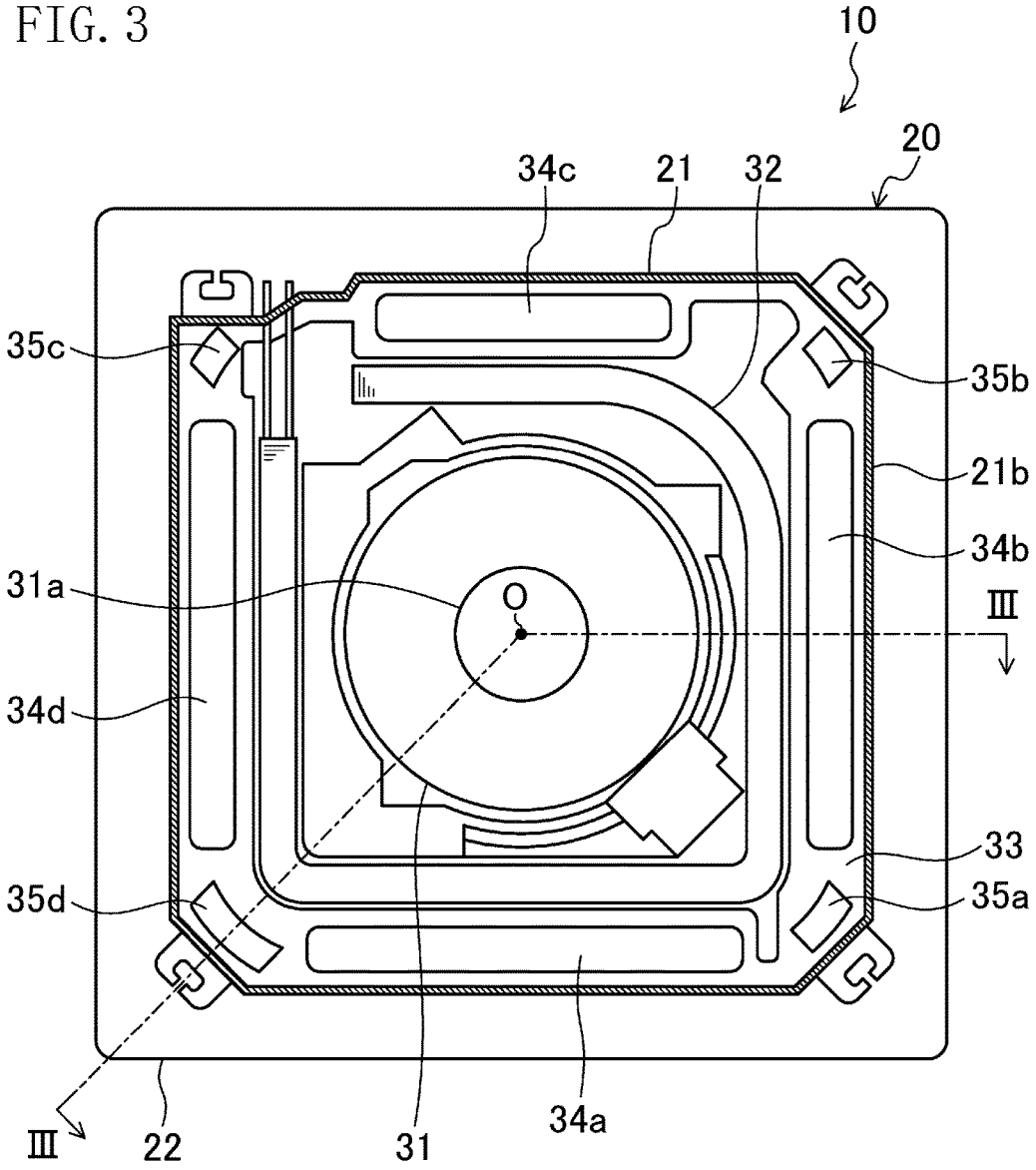
FIG. 3 is a diagram generally illustrating a plan view of the indoor unit from which a top panel of a casing body is omitted.

The indoor heat exchanger (32) is a so-called cross-fin-type fin-and-tube heat exchanger. As illustrated in FIG. 3, the indoor heat exchanger (32) is formed in a surrounding shape in plan view, and is arranged to surround the indoor fan (31). That is, the indoor heat exchanger (32) is arranged in the secondary space (21*d*). The indoor heat exchanger (32) allows the air passing therethrough from the inside to the outside to exchange heat with the refrigerant in the refrigerant circuit.

<Drain Pan>

The drain pan (33) is a member made of so-called Styrofoam. As illustrated in FIG. 4, the drain pan (33) is arranged to block a lower end of the casing body (21). The drain pan (33) has an upper surface provided with a water receiving groove (33*b*) extending along a lower end of the indoor heat exchanger (32). A lower end portion of the indoor heat exchanger (32) is inserted in the water receiving groove (33*b*). The water receiving groove (33*b*) receives drain water generated in the indoor heat exchanger (32).

As illustrated in FIG. 3, the drain pan (33) is provided with four main outlet paths (34*a* to 34*d*) and four auxiliary outlet paths (35*a* to 35*d*). The main outlet paths (34*a* to 34*d*) and the auxiliary outlet paths (35*a* to 35*d*) are paths in which the air that has passed through the indoor heat exchanger (32) flows. The main outlet paths (34*a* to 34*d*) and the auxiliary outlet paths (35*a* to 35*d*) pass through the drain pan (33) in a vertical direction. The main outlet paths (34*a* to 34*d*) are through holes each having an elongated rectangular cross section. The main outlet paths (34*a* to 34*d*) are disposed along the four sides of the casing body (21). Each side of the casing body (21) is provided with one main outlet path. The auxiliary outlet paths (35*a* to 35*d*) are through holes each having a slightly curved rectangular cross section. The auxiliary outlet paths (35*a* to 35*d*) are disposed at the four corners of the casing body (21). Each corner of the casing body (21) is provided with one auxiliary outlet path. That is, the main outlet paths (34*a* to 34*d*) and the auxiliary outlet paths (35*a* to 35*d*) are alternately arranged along the peripheral edge of the drain pan (33).

<Decorative Panel>

The decorative panel (22) is a resinous member formed into a thick rectangular plate-like shape. A lower portion of the decorative panel (22) is in a square shape slightly larger than the top plate (21*a*) of the casing body (21). The decorative panel (22) is arranged to cover the lower end of the casing body (21). The lower surface of the decorative panel (22) serves as a lower surface of the casing (20) and is exposed to the indoor space (500).

Figure 5:
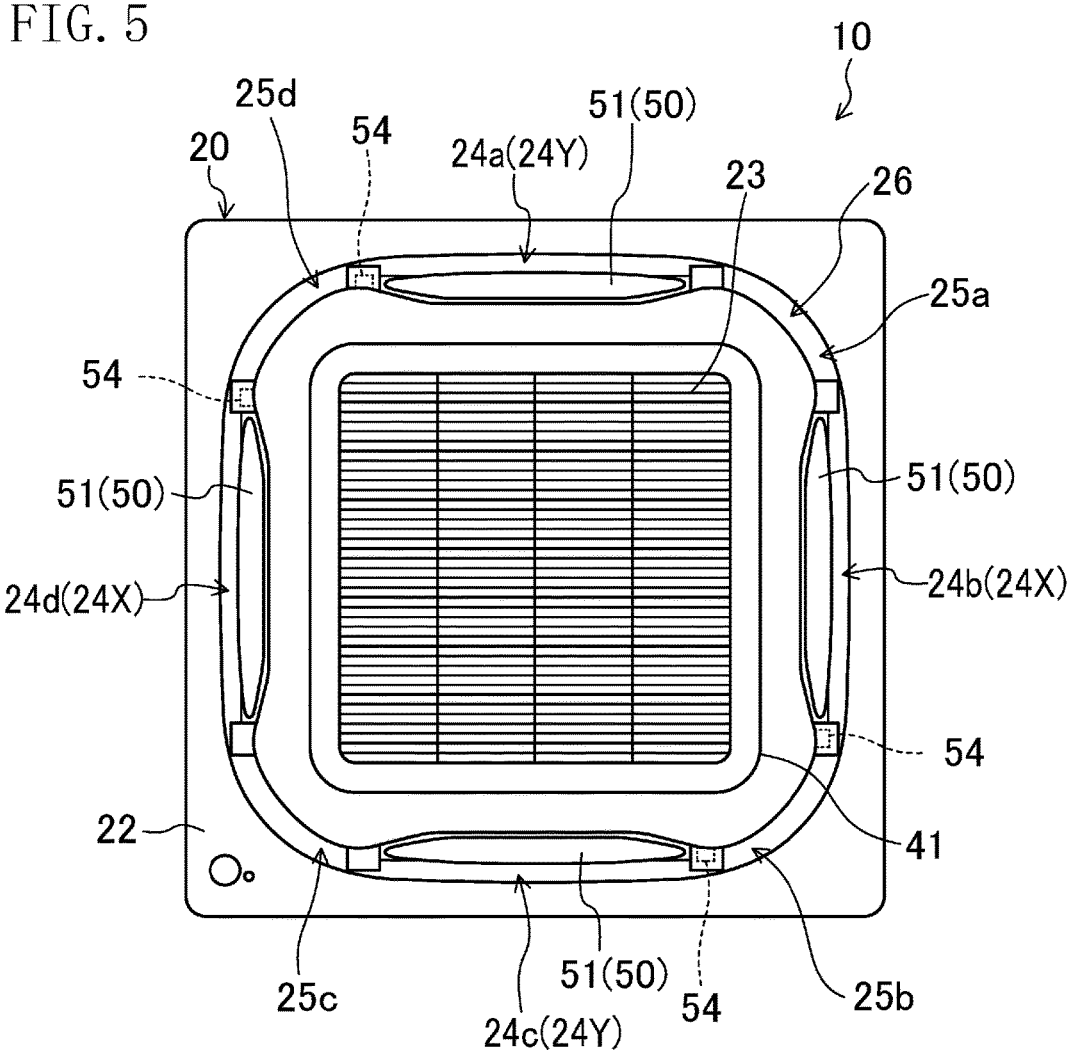
FIG. 5 is a diagram generally illustrating a bottom view of the indoor unit.

As illustrated in FIGS. 4 and 5, one inlet (23) in a square shape (which corresponds to an inlet opening) is formed at a central portion of the decorative panel (22). The inlet (23) passes through the decorative panel (22) in the vertical direction and communicates with the primary space (21*c*) in the casing (20). The air drawn into the casing (20) flows into the primary space (21*c*) through the inlet (23). The inlet (23) is provided with a grid-like intake grille (41). An intake filter (42) is arranged above the intake grille (41).

The decorative panel (22) includes a substantially rectangular annular outlet (26) surrounding the inlet (23). As illustrated in FIG. 5, the outlet (26) is divided into four main outlet openings (24*a* to 24*d*) (which correspond to outlet openings) and four auxiliary outlet openings (25*a* to 25*d*).

Each of the main outlet openings (24*a* to 24*d*) has an elongated shape which corresponds to the cross sectional shape of each of the main outlet paths (34*a* to 34*d*). The main outlet openings (24*a* to 24*d*) are disposed along the four sides of the decorative panel (22). Each side of the decorative panel (22) is provided with one main outlet opening.

The main outlet openings (24*a* to 24*d*) of the decorative panel (22) correspond to the main outlet paths (34*a* to 34*d*) of the drain pan (33) on a one-on-one basis. Each of the main outlet openings (24*a* to 24*d*) communicates with a corresponding one of the main outlet paths (34*a* to 34*d*). That is, the first main outlet opening (24*a*) communicates with the first main outlet path (34*a*). The second main outlet opening (24*b*) communicates with the second main outlet path (34*b*). The third main outlet opening (24*c*) communicates with the third main outlet path (34*c*). The fourth main outlet opening (24*d*) communicates with the fourth main outlet path (34*d*).

Each of the auxiliary outlet openings (25*a* to 25*d*) is in the shape of a quarter of a circle. The auxiliary outlet openings (25*a* to 25*d*) are disposed at the four corners of the decorative panel (22). Each corner of the decorative panel (22) is provided with one auxiliary outlet opening. The auxiliary outlet openings (25*a* to 25*d*) of the decorative panel (22) correspond to the auxiliary outlet paths (35*a* to 35*d*) of the drain pan (33) on a one-on-one basis. Each of the auxiliary outlet openings (25*a* to 25*d*) communicates with a corresponding one of the auxiliary outlet paths (35*a* to 35*d*). That is, the first auxiliary outlet opening (25*a*) communicates with the first auxiliary outlet path (35*a*). The second auxiliary outlet opening (25*b*) communicates with the second auxiliary outlet path (35*b*). The third auxiliary outlet opening (25*c*) communicates with the third auxiliary outlet path (35*c*). The fourth auxiliary outlet opening (25*d*) communicates with the fourth auxiliary outlet path (35*d*).

<Airflow Direction Adjusting Flap>

As illustrated in FIG. 5, each of the main outlet openings (24*a* to 24*d*) is provided with an airflow direction adjusting flap (51). The airflow direction adjusting flap (51) is a member which adjusts the direction of supply airflow (that is, the direction of air coming from the main outlet openings (24*a* to 24*d*)).

The airflow direction adjusting flap (51) changes the direction of supply airflow upward and downward. That is, the airflow direction adjusting flap (51) changes the direction of supply airflow such that the angle between the direction of supply airflow and the horizontal direction changes.

The airflow direction adjusting flap (51) has an elongated plate-like shape extending from one longitudinal end to the other longitudinal end of the main outlet opening (24*a* to 24*d*) formed in the decorative panel (22). As illustrated in FIG. 4, the airflow direction adjusting flap (51) is supported by a support member (52) so as to be rotatable about a central shaft (53) of the airflow direction adjusting flap (51) extending in the longitudinal direction thereof. The airflow direction adjusting flap (51) is curved such that its lateral cross section (a cross section taken in a direction orthogonal to the longitudinal direction) forms a convex shape in a direction away from the central shaft (53) of swing movement.

As illustrated in FIG. 5, a drive motor (54) is coupled to each airflow direction adjusting flap (51). The airflow direction adjusting flap (51) is driven by the drive motor (54), and rotates about the central shaft (53) within a predetermined angle range. Although described in detail later, the airflow direction adjusting flap (51) can move to an airflow blocking position where the airflow direction adjusting flap (51) interrupts the flow of air passing through the main outlet opening (24*a* to 24*d*). The airflow direction adjusting flap (51) also functions as an airflow inhibition mechanism (50) which inhibits the supply airflow through the main outlet opening (24*a* to 24*d*).

<Heat Exchange Temperature Sensor>

As illustrated in FIG. 4, the heat exchange temperature sensor (61) is disposed near the surface of the indoor heat exchanger (32). The heat exchange temperature sensor (61) senses a temperature of the indoor heat exchanger (32).

<Suction Temperature Sensor>

As illustrated in FIG. 4, a suction temperature sensor (62) is disposed near the inlet (23). The suction temperature sensor (62) senses a suction temperature of air being drawn into the casing body (21) through the inlet (23).

<Indoor Controller>

The indoor controller (70) is comprised of a memory and a CPU, and controls the behavior of the indoor unit (10). As illustrated in FIG. 1, the indoor controller (70) is connected to the heat exchange temperature sensor (61), the suction temperature sensor (62), the drive motor (54) of each airflow direction adjusting flap (51), and the indoor fan motor (31*a*) of the indoor fan (31). The indoor controller (70) is also connected to, and can establish communications with, the remote controller (90) and the outdoor controller (85) of the outdoor unit (80).

With the CPU reading and executing various programs stored in the memory, the indoor controller (70) functions as a load index calculator (71) and a motor controller (72) (which corresponds to a controller). The motor controller (72) includes an airflow direction controller (73) which controls the drive motors (54) to control the direction of airflow coming from the main outlet openings (24*a* to 24*d*), and a rotational speed controller (74) which controls the indoor fan motor (31*a*).

The load index calculator (71) calculates an index indicating a load of the indoor space (500) based on the suction temperature of air detected by the suction temperature sensor (62). In particular, the load index calculator (71) calculates the index when the heating operation is carried out in an airflow mode, which will be described later. Specifically, the load index calculator (71) calculates the index of the load of the indoor space (500) based on a difference between a set temperature for the indoor space (500) and a value detected by the suction temperature sensor (62) (i.e., the suction temperature) in the heating operation in the airflow mode. A greater difference means a higher load of the indoor space (500) in the heating operation in the airflow mode. A smaller difference means a lower load of the indoor space (500) in the heating operation in the airflow mode. In the present embodiment, if the difference is greater than a predetermined difference, it means that the index calculated by the load index calculator (71) is greater than a second predetermined value; and if the difference is smaller than the predetermined difference, it means that the index calculated by the load index calculator (71) is smaller than the second predetermined value. Whether the result of calculation of the load index calculator (71) is greater than the second predetermined value or not is used to determine whether the airflow mode needs to be stopped or not.

Desirably, the second predetermined value is set to be an appropriate value according to a size of the indoor space, for example.

Note that the term "heating operation" used in the present embodiment includes supplying warm air into the indoor space (500) by the operation of the compressor (81) and the indoor fan (31), and also includes a state in which the operation of the compressor (81) is temporarily stopped while keeping the operation of the indoor fan (31) (i.e., a circulation operation). However, the "airflow operation" which will be described later is carried out while the compressor (81) is not stopped but in operation.

The airflow direction controller (73) actuates each of the drive motors (54) to control the positions of the airflow direction adjusting flaps (51) independently from one another. Details about the control by the airflow direction controller (73) will be described in "—Control Operation of Airflow Direction Controller—."

The rotational speed controller (74) controls the rotational speed of the indoor fan (31) by control of the indoor fan motor (31*a*).

—Airflow in Indoor Unit—

The indoor fan (31) rotates during the operation of the indoor unit (10). The rotating indoor fan (31) allows the indoor air in the indoor space (500) to pass through the inlet (23) and flows in the primary space (21*c*) in the casing (20). The air which has flowed in the primary space (21*c*) is drawn by the indoor fan (31) and expelled into the secondary space (21*d*).

The air which has flowed into the secondary space (21*d*) is cooled or heated while passing through the indoor heat exchanger (32), and then flows separately into the four main outlet paths (34*a* to 34*d*) and four auxiliary outlet paths (35*a* to 35*d*). The air which has flowed into the main outlet paths (34*a* to 34*d*) is supplied to the indoor space (500) through the main outlet openings (24*a* to 24*d*). The air which has flowed into the auxiliary outlet paths (35*a* to 35*d*) is supplied to the indoor space (500) through the auxiliary outlet openings (25*a* to 25*d*).

That is, the indoor fan (31) generates the flow of air coming into the casing body (21) from the indoor space (500) through the inlet (23) and supplied back into the indoor space (500) through the outlet (26).

In the indoor unit (10) performing a cooling operation, the indoor heat exchanger (32) serves as an evaporator, so that the air before supplied into the indoor space (500) is cooled by the refrigerant while the air passes through the indoor heat exchanger (32). In the indoor unit (10) performing a heating operation, the indoor heat exchanger (32) serves as a condenser, so that the air before supplied into the indoor space (500) is heated by the refrigerant while the air passes through the indoor heat exchanger (32).

—Movement of Airflow Direction Adjusting Flap—

As mentioned above, the airflow direction adjusting flap (51) changes the direction of supply airflow by rotating about the central shaft (53). The airflow direction adjusting flap (51) is movable between a horizontal airflow position illustrated in FIG. 6 and a downward airflow position illustrated in FIG. 7. The airflow direction adjusting flap (51) may further rotate from the downward airflow position illustrated in FIG. 7 and move to an airflow blocking position illustrated in FIG. 8.

Figure 6:
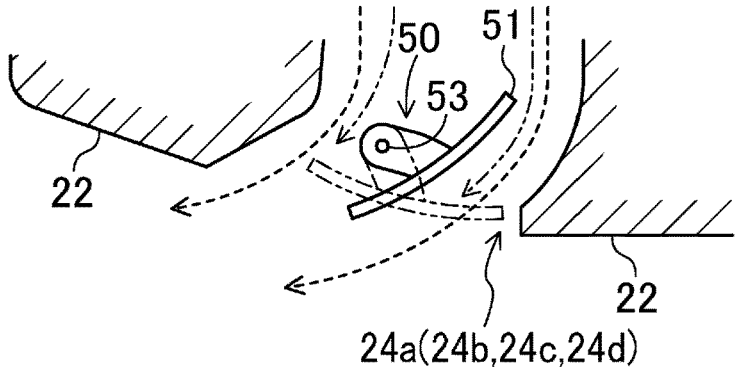
FIG. 6 is a diagram illustrating a cross-sectional view of a main part of a decorative panel, showing an airflow direction adjusting flap in a horizontal airflow position.

When the airflow direction adjusting flap (51) is in the horizontal airflow position illustrated in FIG. 6, the downward direction of the air coming from the main outlet path (34*a* to 34*d*) is changed to a lateral direction, and the supply airflow coming from the main outlet opening (24*a* to 24*d*) is horizontal. In this case, the direction of supply airflow through the main outlet opening (24*a* to 24*d*) (that is, the direction of air coming from the main outlet opening (24*a* to 24*d*)) is set to be, for example, about 25° from the horizontal direction. That is, strictly saying, the direction of the supply airflow is angled slightly downward from the horizontal direction, but substantially the same as the horizontal direction. The horizontal supply airflow allows the air coming from the main outlet opening (24*a* to 24*d*) to reach the wall (502) of the indoor space (500).

The horizontal supply airflow is not limited to an airflow about 25° downward with respect to the horizontal direction, and may also include an airflow about 25° upward, that is, slightly upward, with respect to the horizontal direction.

Figure 7:
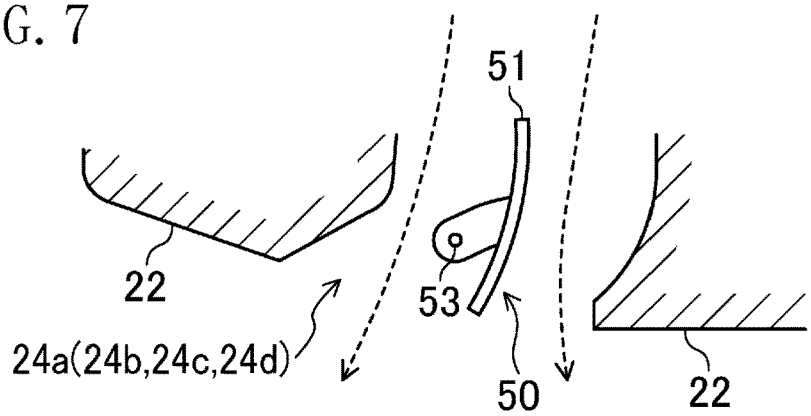
FIG. 7 is a diagram illustrating a cross-sectional view of the main part of the decorative panel, showing the airflow direction adjusting flap in a downward airflow position.

When the airflow direction adjusting flap (51) is in the downward airflow position illustrated in FIG. 7, the downward direction of the air coming from the main outlet path (34*a* to 34*d*) is maintained substantially as it is, and the supply airflow coming from the main outlet opening (24*a* to 24*d*) is directed downward. In this case, strictly saying, the direction of the supply airflow is slightly angled from the vertical direction, that is, obliquely downward, away from the inlet (23).

Figure 8:
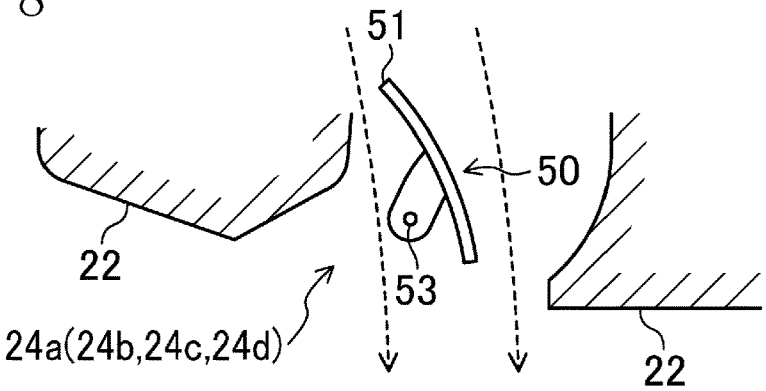
FIG. 8 is a diagram illustrating a cross-sectional view of the main part of the decorative panel, showing the airflow direction adjusting flap in an airflow blocking position.

When the airflow direction adjusting flap (51) is in an airflow blocking position illustrated in FIG. 8, a large portion of the main outlet opening (24*a* to 24*d*) is closed by the airflow direction adjusting flap (51), and the downward direction of the air coming from the main outlet path (34*a* to 34*d*) is changed toward the inlet (23). In this case, the pressure loss of the air passing through the main outlet opening (24*a* to 24*d*) increases, and the total value of the flow rates (i.e., the amounts of air) of the air passing through all of the main outlet openings (24*a* to 24*d*) decreases. However, when the positions of some of the airflow direction adjusting flaps (51) are changed from the positions illustrated in FIG. 6 or 7 to the airflow blocking positions, the flow rate of air (i.e., the amount of air) passing through each of the main outlet openings (24*a* to 24*d*) corresponding to the rest of the airflow direction adjusting flaps (51) taking the positions illustrated in FIG. 6 or 7 are increased, compared to the flow rate prior to the changes of the positions. That is, when the positions of some of all the airflow direction adjusting flaps (51) are changed from the positions illustrated in FIG. 6 or 7 to the airflow blocking positions (FIG. 8), the overall amount of air supplied from the air conditioner (100) is reduced, but the amount of air supplied through the main outlet openings (24*a* to 24*d*) corresponding to the airflow direction adjusting flaps (51) still taking the positions illustrated in FIG. 6 or 7 increases after the change of the positions.

In the airflow blocking position, the air is supplied toward the inlet (23) from the main outlet opening (24*a* to 24*d*). Thus, the air coming from the main outlet opening (24*a* to 24*d*) is immediately sucked in the inlet (23). That is, substantially no air is supplied to the indoor space (500) through the main outlet opening (24*a* to 24*d*) where the airflow direction adjusting flap (51) is taking the airflow blocking position.

—Control Operation of Airflow Direction Controller—

<Basic Airflow in Heating Operation>

First, basic control operation of the motor controller (72) according to the present embodiment will be described with reference to FIG. 9.

—Usual Mode and Airflow Mode—

Figure 9:
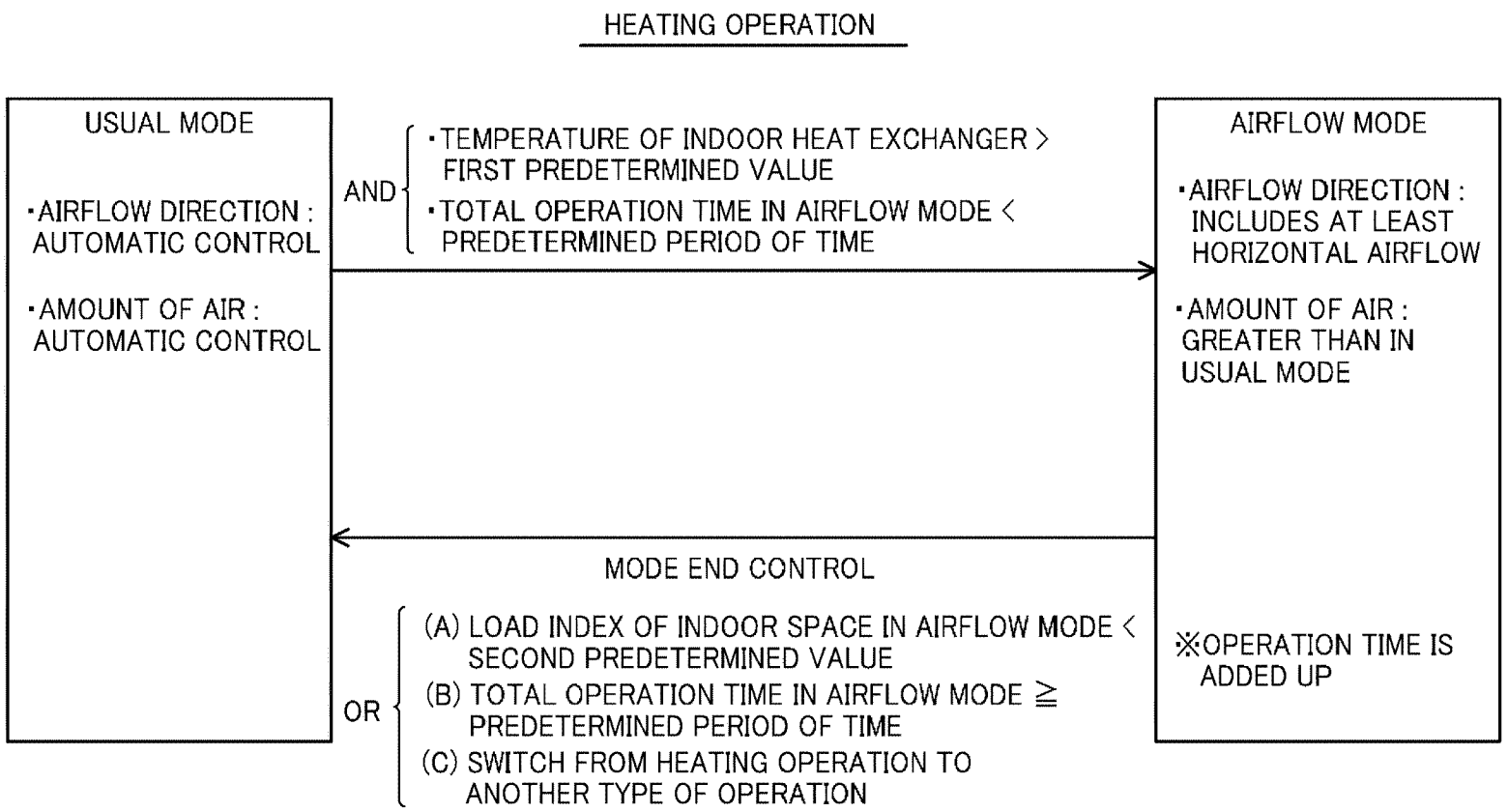
FIG. 9 is a diagram for explaining conditions for switching between a usual mode and an airflow mode in the heating operation.

As illustrated in FIG. 9, the heating operation of the present embodiment is carried out in two modes, i.e., a usual mode and an airflow mode. The heating operation is carried out in the usual mode unless otherwise instructed.

In the usual mode of the heating operation, as illustrated in the "USUAL MODE" in FIG. 9, the motor controller (72) sets the airflow direction and the amount of air supplied from the main outlet openings (24*a* to 24*d*) to an automatic control setting to control the airflow direction adjusting flap (51) and the indoor fan (31).

When the airflow direction is controlled by the automatic control setting in the usual mode, the airflow direction adjusting flap (51) typically takes a downward position illustrated in FIG. 7. When the amount of air is controlled by the automatic control setting in the usual mode, the indoor fan (31) rotates at a sufficiently low rotational speed, compared to the maximum rotational speed of the indoor fan (31).

As written at a portion above the arrow extending from the "USUAL MODE" to the "AIRFLOW MODE" in FIG. 9, when a value detected by the heat exchange temperature sensor (61) (that is, a temperature of the indoor heat exchanger (32)) while the heating operation is carried out in the usual mode exceeds a first predetermined value, the airflow direction controller (73) of the motor controller (72) controls the airflow direction adjusting flap (51) by switching the mode of the heating operation to the airflow mode in which the air is supplied from the main outlet openings (24*a* to 24*d*) at least horizontally. Further, the mode of the heating operation is switched from the usual mode to the airflow mode when the following condition is also satisfied, that is, the total operation time (described later) in the airflow mode is less than a predetermined period of time.

Desirably, the first predetermined value is set to be, for example, about 35 degrees of temperature beforehand.

In general, heating operation is performed when the outside air temperature is relatively low such as in winter season. In such a situation, cold air may enter the indoor space (500) from near the walls of the indoor space (500). The cold air which enters the indoor space (500) will impair the effects of the heating operation. To avoid this, according to the present embodiment, the heating operation is carried out in the airflow mode when the value detected by the heat exchange temperature sensor (61) exceeds the first predetermined value in the heating operation in the usual mode. If the value detected by the heat exchange temperature sensor (61) exceeds the first predetermined value in the heating operation in the usual mode, it means that the air is warmed to a relatively high temperature in the indoor heat exchanger (32). Thus, the usual mode is switched to the airflow mode so that the warm enough air is supplied from the main outlet openings (24*a* to 24*d*) at least in the horizontal direction. This air reaches the wall (502) of the indoor space (500) and flows down along the wall (502). The wall (502) of the indoor space (500) is warmed by the warm air, and the temperature of the wall (502) of the indoor space (500) increases. The air which has reached the wall (502) blocks the cold air from entering the indoor space (500) from the wall (502). Consequently, the difference in temperature between a central portion and a peripheral portion (near the wall) of the indoor space (500) becomes small, and the warm air eventually wraps around the indoor space (500).

In the airflow mode of the present embodiment, as illustrated in the "AIRFLOW MODE" in FIG. 9, the air volume (the amount of air) supplied from the main outlet openings (24*a* to 24*d*) is increased from the air volume (the amount of air) supplied when the value detected by the heat exchange temperature sensor (61) in the heating operation is lower than the first predetermined value (i.e., the usual mode).

Example methods for increasing the amount of air include the following three methods (I) to (III):

(I) The airflow direction controller (73) sets any of the four airflow direction adjusting flaps (51) to the airflow blocking position illustrated in FIG. 8;

(II) The rotational speed controller (74) sets the rotational speed of the indoor fan (31) to a higher rotational speed than in the usual mode; and (III) The airflow direction controller (73) sets any of the airflow direction adjusting flaps (51) to the airflow blocking position illustrated in FIG. 8, and the rotational speed controller (74) sets the rotational speed of the indoor fan (31) to a higher rotational speed than in the usual mode.

According to the method (I), in the airflow mode, the airflow direction adjusting flap (51) of, for example, one main outlet opening (24*a*) is set to the airflow blocking position, and the airflow direction adjusting flaps (51) of the other main outlet openings (24*b* to 24*d*) are set to be horizontal (i.e., the horizontal airflow position). That is, according to the method (I), the total opening area of the main outlet openings (24*a* to 24*d*) is smaller than in the usual mode. In this case, substantially no air is supplied to the indoor space (500) from the main outlet opening (24*a*). However, a greater amount of air than in the usual mode is supplied to the indoor space (500) from each of the rest of the main outlet openings (24*b* to 24*d*) at least substantially in the horizontal direction.

According to the method (II), the rotational speed of the indoor fan (31) is increased. Thus, needless to say, a greater amount of air is supplied substantially in the horizontal direction from the main outlet openings (24*a* to 24*d*) where the airflow direction adjusting flaps (51) are set to the horizontal airflow position.

The method (III) is a case in which both of the methods (I) and (II) are employed. In this case, a greater amount of air than in the methods (I) and (II) is supplied horizontally through the main outlet openings (24*a* to 24*d*) where the airflow direction adjusting flaps (51) take the horizontal airflow position.

The greater amount of air that is increased by either one of the methods (I) to (III) contributes to increasing the speed of air and reliably delivering the relatively warm air to the vicinity of the wall of the indoor space (500). As a result, the wall (502) of the indoor space (500) is warmed more reliably than in the usual mode, and the cold air is more reliably blocked from entering the indoor space (500) from the wall (502).

—Conditions for Ending Airflow Mode—

Now, conditions for ending the airflow mode will be described with reference to FIG. 9.

As written at a portion under the arrow extending from the "AIRFLOW MODE" to the "USUAL MODE" in FIG. 9, the motor controller (72) of the indoor controller (70) and the compressor controller (86) of the outdoor controller (85) carry out a mode end control if any one of the following three conditions (A) to (C) is satisfied during the heating operation in the airflow mode: (A) The result calculated by the load index calculator (71) in the heating operation in the airflow mode (i.e., an index indicating a load of the indoor space (500)) is smaller than a second predetermined value; (B) The total time of the heating operation in the airflow mode reaches a predetermined period of time; and (C) The type of operation is switched from the heating operation to another operation different from the heating operation. Regarding the condition (A), the suction temperature, that is, the temperature in the indoor space (500), gradually approaches a set temperature as the indoor space (500) is warmed to a certain degree by the heating operation in the airflow mode. When the difference between the suction temperature and the set temperature becomes smaller than a predetermined difference, the index indicating the load of the indoor space (500) becomes smaller than the second predetermined value. If this occurs, the motor controller (72) and the compressor controller (86) determine that the indoor space (500) is warm enough and that no further heating operation in the airflow mode is necessary, and carry out the mode end control.

In the mode end control, the motor controller (72) continues to monitor the temperature of the indoor heat exchanger (32) which the heat exchange temperature sensor (61) keeps detecting all the time. In the mode end control, first, the compressor controller (86) decreases the operational frequency of the compressor (81) from the operational frequency immediately before the start of the mode end control so that the temperature of the indoor heat exchanger (32) detected by the heat exchange temperature sensor (61) falls to or below a third predetermined value. The decrease in the operational frequency of the compressor (81) reduces the power itself of the compressor (81). The temperature of the indoor heat exchanger (32) drops accordingly. When the temperature of the indoor heat exchanger (32) falls to or below the third predetermined value, the airflow direction controller (73) of the motor controller (72) switches the control setting for the airflow direction of each of the airflow direction adjusting flaps (51) to the automatic control setting, and the rotational speed controller (74) of the motor controller (72) switches the control setting for the amount of air to the automatic control setting. That is, when the temperature of the indoor heat exchanger (32) falls to or below the third predetermined value after the mode end control, the mode of the heating operation is switched to the usual mode. The airflow direction after the switching to the usual mode is typically directed downward as illustrated in FIG. 7. The amount of air after the switching to the usual mode decreases from the amount of air in the airflow mode.

The third predetermined value used in the mode end control is set to be smaller than or equal to the first predetermined value used in switching the usual mode to the airflow mode. In particular, it is preferable that third predetermined value is set to be smaller than the first predetermined value. In one example, where both of the first and third predetermined values are set to be about 35° C., the first and third predetermined values can be about 36° C. and 34° C., respectively. Both of the first and third predetermined values are threshold values of the temperature of the indoor heat exchanger (32). However, actual temperatures of the indoor heat exchanger (32) are not strictly maintained at a constant temperature, but vary in a predetermined range. Thus, depending on the magnitude of the first and third predetermined values, the temperature of the indoor heat exchanger (32) may exceed or fall below the first and third predetermined values within a short time. As a result, hunting may occur in which the modes are frequently changed. To prevent the hunting between modes, the first predetermined value is set to be higher than the third predetermined value by about 2° C. in the present embodiment.

Regarding the condition (B), the motor controller (72) adds up the operation time in the airflow mode. As written at the portion above the arrow extending from the "USUAL MODE" to the "AIRFLOW MODE" in FIG. 9, the usual mode can be switched back to the airflow mode unless the total operation time in the airflow mode reaches the predetermined period of time during the usual mode. In such a case where the airflow mode temporarily ends and is restarted thereafter, the motor controller (72) updates the total operation time in the airflow mode by adding the operation time in the airflow mode after the restart to the total operation time in the airflow mode prior to the temporary end. If the total operation time in the airflow mode reaches the predetermined period of time during the operation in the airflow mode, as in the condition (B), the motor controller (72) and the compressor controller (86) determine that the indoor space (500) is warm enough by the heating operation in the airflow mode and that no further heating operation in the airflow mode is necessary, and carry out the mode end control.

Particulars of the mode end control in the condition (B) are the same as, or similar to, those of the mode end control in the condition (A).

Preferably, the total operation time is reset when, for example, settings are changed via the remote controller (90). The "settings" used herein include switching of the operation type from the heating operation to the cooling operation, and forcibly turning off the airflow mode, for example.

The condition (C) is a case in which the operation type of the air conditioner (100) is switched from the heating operation to another operation different from the heating operation. Examples of the operation different from the heating operation include a defrosting operation and a cooling operation. The airflow mode of the present embodiment is a mode for the heating operation. Thus, when the operation type of the air conditioner (100) is switched to an operation different from the heating operation, the benefits of carrying out the operation in the airflow mode are lost. That is why the mode end control is carried out when the condition (C) is satisfied.

Particulars of the mode end control in the condition (C) are the same as, or similar to, those of the mode end control in the condition (A).

The conditions (A) to (C) are not the only conditions for performing the mode end control. Other conditions include, for example, a state in which the operation of the compressor (81) is temporarily stopped (i.e., a so-called thermo-off state).

<Example Application of Airflow in Heating Operation: Airflow Rotation>

Now, an airflow rotation which is an example application of the airflow mode, described above, will be described. The airflow rotation is carried out as the airflow mode when the value detected by the heat exchange temperature sensor (61) in the heating operation in the usual mode is greater than the first predetermined value, and the total operation time in the airflow mode is less than a predetermined value.

Figure 10:
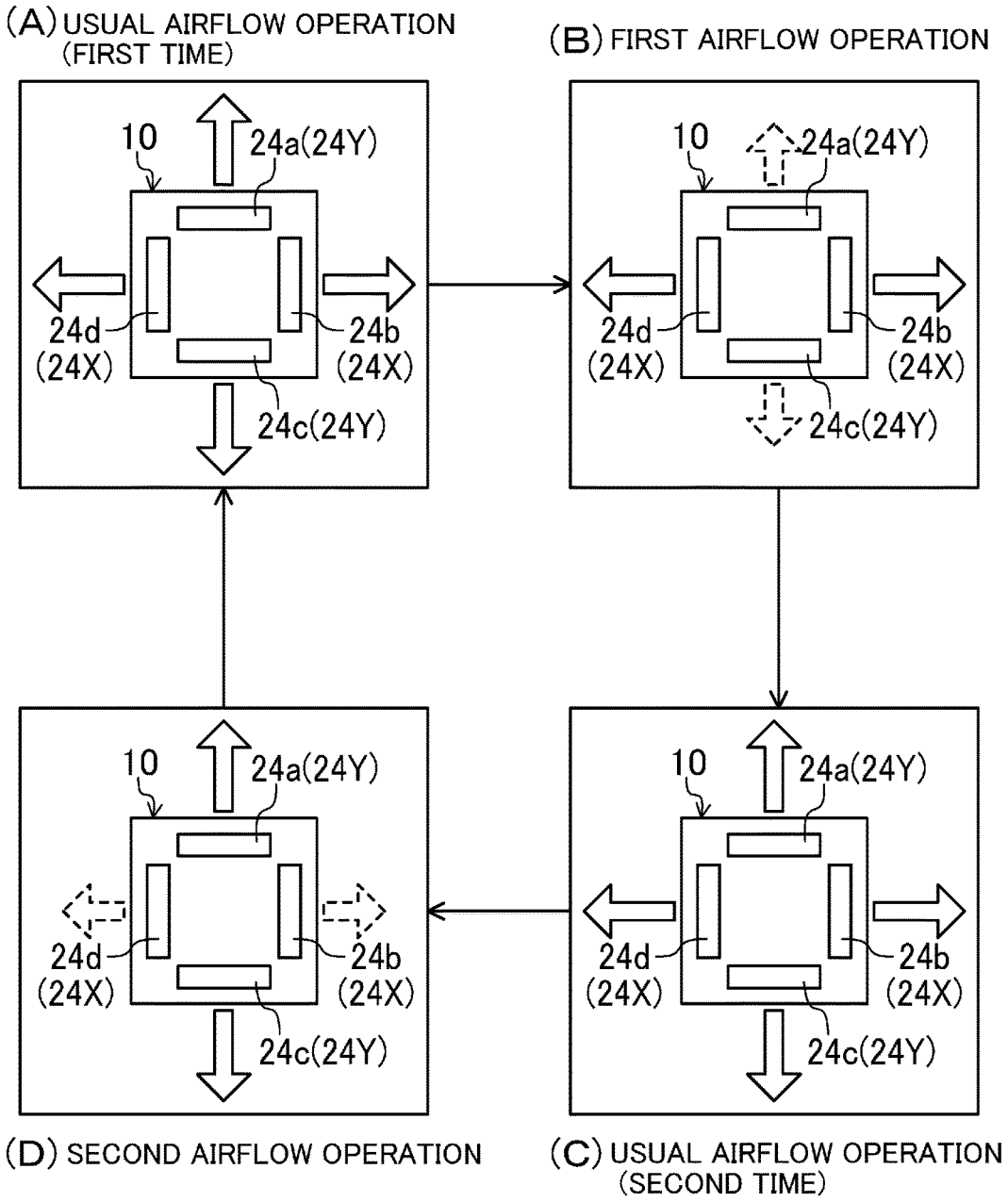
FIG. 10 is a diagram for explaining a single airflow rotation cycle performed by the indoor unit, and schematically illustrates a bottom surface of the indoor unit making each movement.

In the example application, the airflow direction controller (73) controls the position of the airflow direction adjusting flap (51) such that the indoor unit (10) can carry out a usual airflow operation, a first airflow operation, and a second airflow operation, which will be described later. The airflow direction controller (73) also controls the positions of the airflow direction adjusting flaps (51) of the main outlet openings (24*a* to 24*d*) such that the indoor unit (10) carries out an airflow rotation illustrated in FIG. 10. As illustrated in FIG. 10, a first-time usual airflow operation, a first airflow operation, a second-time usual airflow operation, and a second airflow operation are sequentially performed in a single cycle of the airflow rotation. That is, in a single cycle of the airflow rotation, the usual airflow operation is performed twice; the first airflow operation is performed once; and the second airflow operation is performed once.

Note that the rotational speed of the indoor fan (31) is kept substantially constant during the airflow rotation. An example case will be described below in which the method (I) is employed as a method for increasing the amount of the air during the airflow rotation.

In the following description, for convenience of explanation, the second and fourth main outlet openings (24*b*) and (24*d*) along the two sides of the decorative panel (22) facing each other are called "first opening (24X)" and the first and third main outlet openings (24*a*) and (24*c*) are called "second opening (24Y)" as illustrated in FIGS. 2, 5, and 10.

In the usual airflow operation in the heating operation, the airflow direction controller (73) sets the airflow direction adjusting flaps (51) of all the main outlet openings (24*a* to 24*d*) to the downward airflow position. Thus, the air is supplied downward from the four main outlet openings (24*a* to 24*d*) in the usual airflow operation in the heating operation.

In the first airflow operation in the heating operation, the airflow direction controller (73) sets the airflow direction adjusting flaps (51) of the two main outlet openings (24*b*, 24*d*) which form the first opening (24X) to the horizontal airflow position, and sets the airflow direction adjusting flaps (51) of the two main outlet openings (24*a*, 24*c*) which form the second opening (24Y) to the airflow blocking position. Thus, the air is supplied to the indoor space (500) from the second and fourth main outlet openings (24*b*) and (24*d*), and substantially no air is supplied to the indoor space (500) from the first and third main outlet openings (24*a*) and (24*c*). The amount of air and speed of air coming from the second and fourth main outlet openings (24*b*) and (24*d*) are higher than the amount of air and speed of air in the usual airflow operation. Thus, in the first airflow operation, the air is supplied substantially in the horizontal direction from the second and fourth main outlet openings (24*b*) and (24*d*) at a higher flow speed and in a greater amount than in the usual airflow operation.

In the second airflow operation in the heating operation, the airflow direction controller (73) sets the airflow direction adjusting flaps (51) of the two main outlet openings (24*a*, 24*c*) which form the second opening (24Y) to the horizontal airflow position, and sets the airflow direction adjusting flaps (51) of the two main outlet openings (24*b*, 24*d*) which form the first opening (24X) to the airflow blocking position. Thus, the air is supplied to the indoor space (500) from the first and third main outlet openings (24*a*) and (24*c*), and substantially no air is supplied to the indoor space (500) from the second and fourth main outlet openings (24*b*) and (24*d*). The amount of air and speed of air coming from the first and third main outlet openings (24*a*) and (24*c*) are higher than the amount of air and speed of air in the usual airflow operation. Thus, in the second airflow operation, the conditioned air is supplied substantially in the horizontal direction from the two, i.e., first and third, main outlet openings (24*a*) and (24*c*) at a higher flow speed and in a greater amount than in the usual airflow operation.

Note that the air is supplied from the auxiliary outlet openings (25*a* to 25*d*) in all of the usual airflow operation, the first airflow operation, and the second airflow operation.

In the single cycle, illustrated in FIG. 10, of the airflow rotation in the heating operation, the first-time usual airflow operation, the first airflow operation, the second-time airflow operation, and the second airflow operation have the same duration time (e.g., 120 seconds).

<Temperature Distribution of Indoor Space in Heating Operation>

Temperature distribution of the indoor space (500) in the heating operation will be described with reference to FIG. 11.

Figure 11:
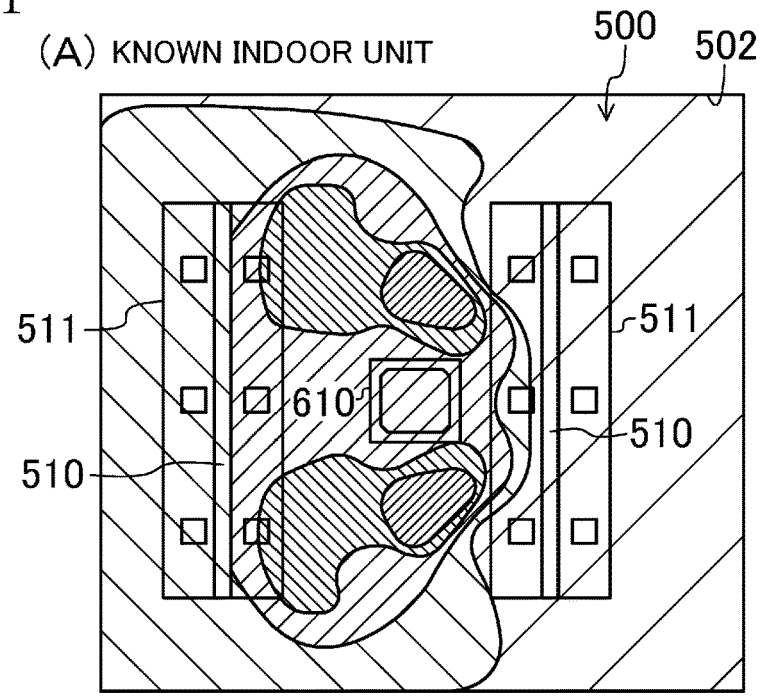
FIG. 11 illustrates a plan view of the indoor space, showing temperature distributions in the indoor space when the indoor unit is performing the airflow rotation during a heating operation.
Figure 11:
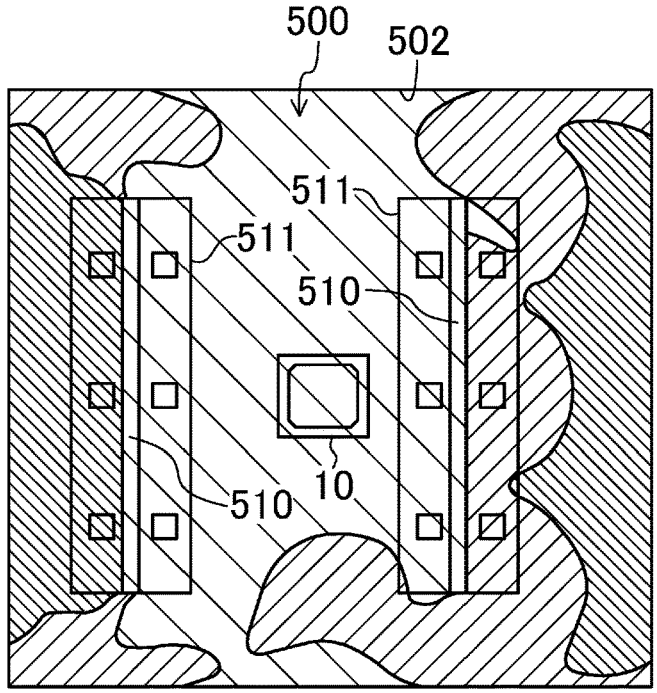

FIG. 11 illustrates simulation results of the temperature distribution of the indoor space (500) during the heating operation of the indoor unit (10). FIG. 11 illustrates temperatures at a height of 60 cm above the floor surface of the indoor space (500) after 20 minutes from the start of the heating operation of the indoor unit (10). In FIG. 11, higher temperatures are illustrated by a higher density of hatching.

Note that such a room as follows is used as a simulation target room which has approximately a square floor surface and is furnished with two long desks (511) arranged parallel to each other with a partition (510) provided at a middle portion of each desk. The indoor unit (10) is located at approximately a center of the ceiling of the indoor space (500).

First, temperature distribution of the indoor space (500) provided with a known indoor unit (610) will be described with reference to FIG. 11A.

In a heating operation, the known indoor unit (610) sets the airflow direction adjusting flaps (51) of all the main outlet openings (24*a* to 24*d*) to, for example, the downward airflow position, similarly to the usual mode described above. The known indoor unit (610) supplies air which has been heated while passing through the indoor heat exchanger (32) substantially toward the floor surface from all the main outlet openings (24*a* to 24*d*).

As illustrated in FIG. 11A, a central region of the indoor space (500) under the indoor unit (610) has a very high temperature. This may be because the warm conditioned air supplied downward from the indoor unit (610) remains in the central region of the indoor space (500) in between the two partitions (510).

On the other hand, the temperature is not sufficiently increased in a peripheral region of the indoor space (500) apart from the indoor unit (610). This may be because the warm conditioned air supplied downward from the indoor unit (610) could not reach the region near the walls (502) over the partitions (510).

Now, temperature distribution of the indoor space (500) provided with the indoor unit (10) of the present embodiment will be described with reference to FIG. 11B. The indoor unit (10) carries out the airflow rotation as the airflow mode, as described in the above example application.

In the usual airflow operation, the warm conditioned air supplied downward from the indoor unit (10) is supplied to a central region of the indoor space (500) in between the two partitions (510). Thus, the temperature increases in the central region of the indoor space (500) under the indoor unit (10). However, since the usual airflow operation is performed intermittently, the temperature in the central region of the indoor space (500) does not increase excessively.

On the other hand, in the first and second airflow operations, the warm conditioned air is supplied substantially in the horizontal direction from the indoor unit (10) at a higher flow speed and in a greater amount than in the usual airflow operation. Thus, in the first and second airflow operations, the warm conditioned air supplied from the indoor unit (10) reaches the wall (502) of the indoor space (500) over the partitions (510). The temperature therefore increases in the peripheral region, too, of the indoor space (500) apart from the indoor unit (10).

In the first and second airflow operations, the warm conditioned air supplied from the indoor unit (10) reaches the wall (502) of the indoor space (500) and flows down along the wall (502). The wall (502) of the indoor space (500) is warmed by the conditioned air. The temperature of the wall (502) of the indoor space (500) increases accordingly. The temperature in the peripheral region of the indoor space (500) is less likely to drop because of the wall (502) warmed by the conditioned air.

The airflow rotation in the heating operation greatly reduces the difference in the temperature between the central and peripheral regions of the indoor space (500), compared to the case where the known indoor unit (610) performs the heating operation.

<Airflow in Cooling Operation>

In the cooling operation, the airflow direction controller (73) sets the airflow direction adjusting flaps (51) of, for example, all the main outlet openings (24*a* to 24*d*) to alternately take the horizontal airflow position and the downward airflow position. Thus, airflow of the relatively cool air supplied from the main outlet openings (24*a* to 24*d*) varies according to the movement of each of the airflow direction adjusting flaps (51).

Advantages of Embodiment

The air conditioner (100) of the present embodiment changes its operational mode for the heating operation to the airflow mode when the temperature of the indoor heat exchanger (32) is higher than the first predetermined value in the heating operation. In the airflow mode, warmed air (or warm air) is supplied from the outlet openings (24*a* to 24*d*) at least in the horizontal direction. Thus, the warm air can reach the vicinity of the wall of the indoor space (500), and blocks the cold air from coming into the indoor space (500) from near the wall. Entrance of cold air into the indoor space (500) from near the wall is avoided in this manner. Consequently, the difference in temperature between a central portion and a peripheral portion (near the wall) of the indoor space (500) becomes small. Further, the warm air flows along the wall of the indoor space (500) and therefore wraps around the whole of the indoor space (500).

Further, according to the present embodiment, an amount of air supplied from the outlet openings (24*a* to 24*d*) in the heating operation in the airflow mode is increased from the amount of air supplied when the temperature of the indoor heat exchanger (32) is lower than the first predetermined value in the heating operation (i.e., the usual mode). Thus, in the airflow mode, the warm air can reach the vicinity of the wall of the indoor space (500) more easily. Entrance of cold air into the indoor space (500) from near the wall can be avoided more reliably.

According to the present embodiment, when the index indicating the load of the indoor space (500) in the heating operation in the airflow mode is smaller than the second predetermined value, the mode end control is carried out to end the airflow mode. The indoor space (500) will have a low load when the entrance of cold air into the indoor space (500) from near the wall of the indoor space (500) is reduced and the whole of the indoor space (500) is warmed by the operation in the airflow mode. According to the present embodiment, the airflow mode is ended when the load of the indoor space (500) is reduced to a low load by the heating operation in the airflow mode, for no further operation in the airflow mode is necessary. That is, the operation in the airflow mode is carried out only when it is necessary.

According to the present embodiment, the index is determined by the difference between the set temperature and the suction temperature during the heating operation in the airflow mode. This means that the index indicating the load of the indoor space (500) can be determined by a simple method.

In the mode end control according to the present embodiment, the compressor controller (86) decreases the operational frequency of the compressor (81) from the operational frequency immediately before the start of the mode end control so that the value detected by the heat exchange temperature sensor (61) falls to or below the third predetermined value. The decrease in the operational frequency of the compressor (81) reduces the power of the compressor (81). The temperature of the indoor heat exchanger (32) and the temperature of supply air drop accordingly. The airflow mode is ended when the value detected by the heat exchange temperature sensor (61) falls to or below the third predetermined value.

In particular, the third predetermined value, which is a threshold value for determining the end of the airflow mode, is smaller than or equal to the first predetermined value, which is a threshold value for determining transition to the airflow mode. In particular, the temperature of the indoor heat exchanger (32) and the temperature of supply air vary within a certain range. Thus, in one preferred embodiment, the third predetermined value, which is a threshold value for determining the end of the airflow mode, is smaller than the first predetermined value. Setting the values in this manner allows the motor controller (72) and the compressor controller (86) to end the airflow mode without being affected by the phenomenon in which the values detected by the heat exchange temperature sensor (61) vary.

The mode end control is carried out also when the total time of the heating operation in the airflow mode reaches a predetermined period of time. The fact that the total time of the heating operation in the airflow mode reaches the predetermined period of time means that the airflow mode is carried out for a sufficient time. The operation in the airflow mode for a sufficient time sufficiently reduces the entrance of cold air from near the wall of the indoor space (500), and warms up the indoor space (500) to a certain degree. Thus, the motor controller (72) and the compressor controller (86) carry out the mode end control when the total operation time in the airflow mode reaches the predetermined period of time. This control avoids unnecessary operation in the airflow mode.

First Variation of Embodiment

Figure 12:
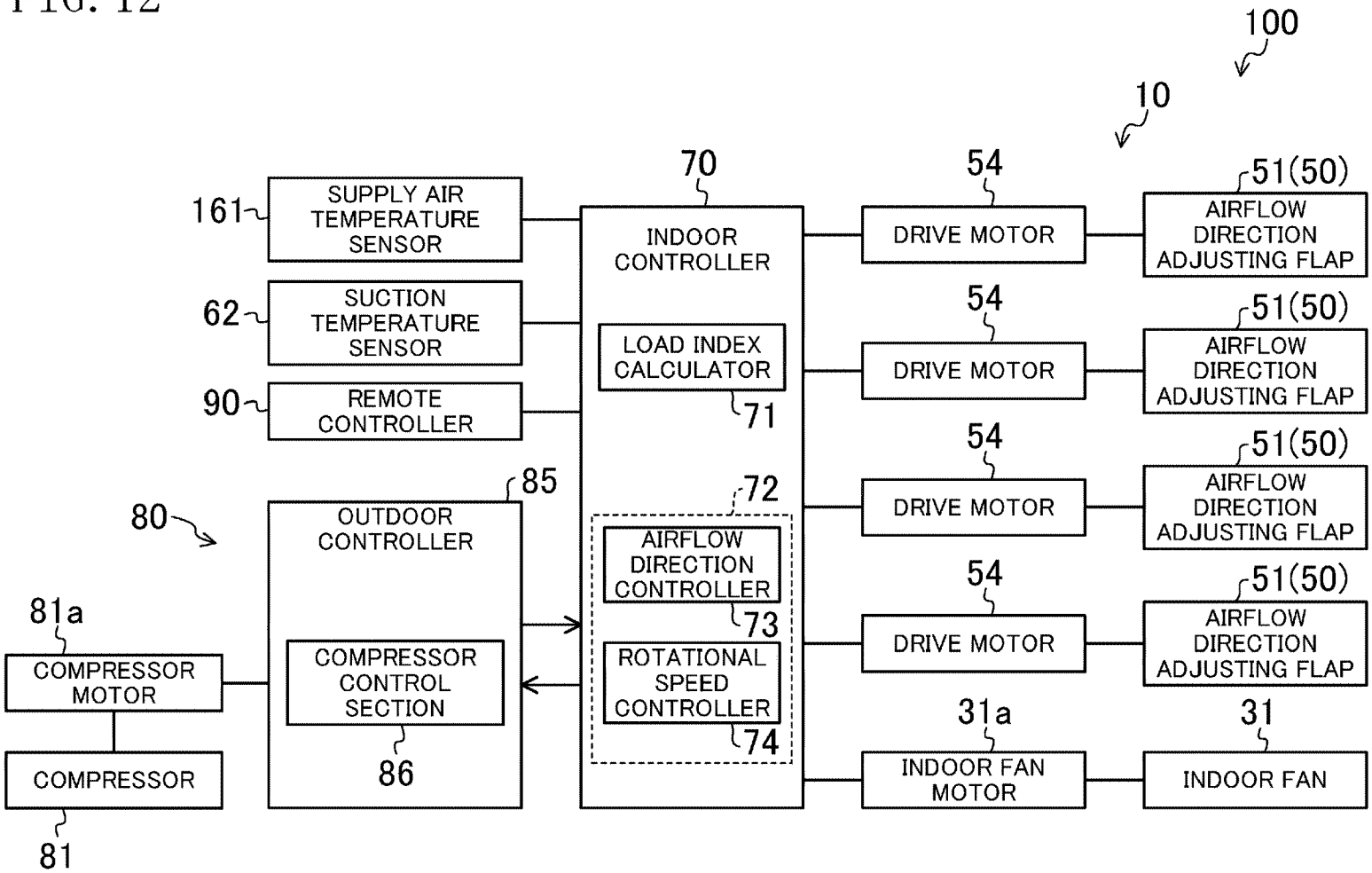
FIG. 12 is a block diagram schematically illustrating an indoor controller and devices connected to the indoor controller according to a first variation of the embodiment.

As illustrated in FIG. 12, a supply air temperature sensor (161) may be provided as a first temperature detector instead of the heat exchange temperature sensor (61).

The supply air temperature sensor (161) is provided near the outlet opening (24*a* to 24*d*) to detect a temperature of air coming from the outlet opening (24*a* to 24*d*).

In this case, the motor controller (72) controls the airflow direction adjusting flap (51) to operate in the airflow mode if the temperature of supply air detected by the supply air temperature sensor (161) is higher than the first predetermined value in the heating operation. In the mode end control, the supply air temperature is monitored instead of the temperature of the indoor heat exchanger (32), and the operational frequency of the compressor (81) is reduced so that the supply air temperature falls to or below the third predetermined value. The airflow mode is ended when the supply air temperature falls to or below the third predetermined value.

Using the supply air temperature, instead of the temperature of the indoor heat exchanger (32), can also provide the effects and advantages similar to those in the embodiment described above.

Second Variation of Embodiment

The indoor unit (10) is not limited to the ceiling embedded type. The indoor unit (10) may be of a ceiling suspended type or of a wall hanging type. Whatever the type of the indoor unit (10) is, the operation in the airflow mode may be suitably carried out, in which the air is supplied from the outlet opening (24*a* to 24*d*) at least horizontally, when the temperature of the indoor heat exchanger (32) or the supply air temperature is higher than the first predetermined value in the heating operation.

Note that in the ceiling mounted type and the wall hanging type, air may be supplied slightly upward, using the Coanda effect, with respect to the horizontal airflow in the ceiling embedded type during the operation in the airflow mode.

Third Variation of Embodiment

The angle of the airflow direction adjusting flap (51), while taking the horizontal airflow position, with respect to the horizontal direction may be finely adjusted as necessary, according to the distance from the location of the indoor unit (10) and the wall surface of the indoor space (500), so that the air coming from the main outlet opening (24*a* to 24*d*) can reach the vicinity of the wall of the indoor space (500). The distance from the location of the indoor unit (10) to the wall surface of the indoor space (500) may be input to the indoor controller (70) at the installation of the indoor unit (10) in the indoor space (500) by a worker who installs the indoor unit (10). Alternatively, a sensor for detecting the distance may be attached to the indoor unit (10) in advance.

Fourth Variation of Embodiment

In determining whether to carry out another operation in the airflow mode after the operation in the previous airflow mode, the following condition may be imposed, that is, there is a certain difference or more between the floor temperature of the indoor space (500) and the suction temperature, as a condition for transition from the usual mode to the airflow mode, in addition to the conditions, described earlier, concerning the temperature of the indoor heat exchanger (32) or the temperature of supply air, and the total operation time in the airflow mode. In this case, it is preferable that the floor temperature of the indoor space (500) be detected by a floor temperature sensor (not shown).

However, during the heating operation, the floor temperature detected by the floor temperature sensor tends to be higher than the actual floor temperature due to the effect of air supplied. Thus, in this case, it is more preferable to correct the value detected by the floor temperature sensor and impose the following condition, that is, there is a certain difference or more between the corrected value detected by the floor temperature sensor and the uncorrected value detected by the suction temperature sensor (62).

The certain difference may be changed to a suitable value in accordance with the environment of the indoor space (500) via the remote controller (90).

Note that the total operation time in the airflow mode does not necessarily have to be calculated. In the case in which the total operation time in the airflow mode is not calculated, the condition concerning the total operation time is omitted from the conditions for mode transition.

Fifth Variation of Embodiment

The load index calculator (71) may use, when calculating the index indicating the load of the indoor space (500), a value corrected from the value detected by the suction temperature sensor (62) instead of using the value itself detected by the suction temperature sensor (62). Thus, an index accurately indicating the actual load of the indoor space (500) can be obtained. This method is effective when the air coming from the main outlet opening (24*a* to 24*d*) and the auxiliary outlet opening (25*a* to 25*d*) does not circulate in the indoor space (500) and is directly drawn into the casing (20) through the inlet (23).

Sixth Variation of Embodiment

The method for calculating the index indicating the load of the indoor space (500) during the heating operation in the airflow mode is not limited to the method using the set temperature and the value detected by the suction temperature sensor (62). For example, the index may be calculated using a mean value of the value detected by the suction temperature sensor (61) and a floor temperature of the indoor space (500). In this case, not the value itself detected by the suction temperature sensor (62), but a value corrected from the value detected by the suction temperature sensor (62) may be used.

The index may be determined from a wall surface load or a floor surface load of the indoor space (500).

The index may be calculated at predetermined intervals, or may be calculated when a user of the indoor space (500) sends an instruction via a remote controller.

Seventh Variation of Embodiment

The index indicating the load of the indoor space (500) in the heating operation may be calculated by using a value detected, or a corrected value from the value detected, by a sensor provided separately in the indoor space (500) for detecting a room temperature, instead of the suction temperature sensor (62). Types of the sensor provided separately for detecting a room temperature may include not only a wired communication sensor, but also a wireless communication sensor.

Eighth Variation of Embodiment

The number of main outlet openings (24*a* to 24*d*) is not limited to four. For example, one or two main outlet openings may be provided.

Ninth Variation of Embodiment

The indoor unit (10) may have a shutter for closing the main outlet opening (24*a* to 24*d*) in addition to the airflow direction adjusting flap (51) as an airflow inhibition mechanism. Preferably, in this case, the airflow inhibition mechanism is provided to correspond to each of the main outlet openings (24*a* to 24*d*). For example, the airflow inhibition mechanism may be configured as an open/close shutter.

Tenth Variation of Embodiment

The example application of the airflow mode described above (i.e., the airflow rotation) is not limited to such rotation as illustrated in FIG. 10. For example, the airflow rotation may be carried out by repeating the usual airflow operation, the first airflow operation, and the second airflow operation in a sequential manner.

Eleventh Variation of Embodiment

The first and second airflow operations of the example application of the airflow mode (i.e., the airflow rotation) may be carried out by supplying the air to the indoor space (500) from two main outlet openings (24*a* to 24*d*) arranged next to each other, and setting the airflow direction adjusting flaps (51) of the other two main outlet openings (24*a* to 24*d*) arranged next to each other to the airflow blocking position.

Twelfth Variation of Embodiment

It is not essential to carry out the control to increase the amount of air. In carrying out the control to increase the amount of air, methods except the methods (I) to (III) described above may be employed.

Thus, as a method for increasing the amount of air in the airflow rotation, the method (II) or (III) may be employed instead of the method (I), or any other method besides the methods (I) to (III) may be employed.

Thirteenth Variation of Embodiment

The duration time of the operations in the airflow rotation does not have to be the same (e.g., 120 seconds), but may be different among the operations.

Fourteenth Variation of Embodiment

If the method (I) or (III) is employed as the control to increase the amount of air, the airflow direction adjusting flap (51) may close the corresponding main outlet opening (24*a* to 24*d*) completely, instead of taking the airflow blocking position in FIG. 8.

Fifteenth Variation of Embodiment

In the above embodiment, the conditions (A) to (C) have been described as the conditions for ending the airflow mode. However, the conditions for ending the airflow mode are not necessarily limited to the conditions (A) to (C). The airflow mode may be ended when another condition besides the conditions (A) to (C) is satisfied.

Sixteenth Variation of Embodiment

The method for carrying out the mode end control for ending the airflow mode is not limited to reducing the operational frequency of the compressor (81) and thereby dropping the temperature of the indoor heat exchanger (32). The third predetermined value used in the mode end control does not necessarily have to be lower than or equal to the first predetermined value.

INDUSTRIAL APPLICABILITY

As can be seen from the foregoing description, the present invention is useful as an air conditioner having an indoor unit which supplies air to an indoor space.

EXPLANATION OF REFERENCES

10 Indoor Unit
20 Casing (Indoor Casing)
24*a* to 24*d* Main Outlet Opening (Outlet Opening)
51 Airflow Direction Adjusting Flap
61 Heat Exchange Temperature Sensor (First Temperature Detector)
62 Suction Temperature Sensor (Second Temperature Detector)
71 Load Index Calculator
72 Motor Controller (Controller)
81 Compressor
86 Compressor Controller
100 Air Conditioner
500 Indoor Space

What is claimed is:

1. An air conditioner having an indoor unit which supplies air to an indoor space, the air conditioner comprising:

an indoor casing provided with an outlet opening;

an airflow direction adjusting flap which is provided at the outlet opening and changes a direction of air supplied from the outlet opening in a vertical direction;

an indoor heat exchanger which is provided in the indoor casing and heats the air by a refrigerant before the air is supplied from the outlet opening in a heating operation;

a first temperature detector which detects a temperature of the indoor heat exchanger or a temperature of the air supplied from the outlet opening; and a processor coupled with a memory storing a program which, when executed by the processor, performs a process of controlling the airflow direction adjusting flap to operate in an airflow mode, in which the air is supplied from the outlet opening in a substantially horizontal direction or upward with respect to the substantially horizontal direction, when a value detected by the first temperature detector is greater than a first predetermined value in the heating operation, wherein the process increases an amount of air supplied from the outlet opening in the airflow mode from an amount of air supplied from the outlet opening when the value detected by the first temperature detector in the heating operation is smaller than the first predetermined value.

2. The air conditioner of claim 1, wherein execution of the program further causes the processor to:

calculate an index indicating a load of the indoor space, wherein the process carries out a mode end control to end the airflow mode when the index during the heating operation in the airflow mode is smaller than a second predetermined value.

3. The air conditioner of claim 2, wherein the indoor casing is further provided with an inlet opening, the air conditioner further comprises a second temperature detector which detects a suction temperature of air sucked into the indoor casing from the inlet opening, and when the index during the heating operation in the airflow mode is smaller than the second predetermined value is when a difference between a set temperature and the suction temperature during the heating operation in the airflow mode is smaller than a predetermined difference.

4. The air conditioner of claim 2, further comprising:

a compressor which compresses a refrigerant, wherein in the mode end control, the process decreases an operational frequency of the compressor so that the value detected by the first temperature detector falls to or below a third predetermined value, and the process ends the airflow mode when the value detected by the first temperature detector falls to or below the third predetermined value.

5. The air conditioner of claim 4, wherein the third predetermined value is smaller than or equal to the first predetermined value.

6. The air conditioner of claim 1, wherein the process carries out a mode end control to end the airflow mode when a total operation time of the heating operation in the airflow mode reaches a predetermined period of time.

7. The air conditioner of claim 3, further comprising:

a compressor which compresses a refrigerant, wherein in the mode end control, the process decreases an operational frequency of the compressor so that the value detected by the first temperature detector falls to or below a third predetermined value, and the process ends the airflow mode when the value detected by the first temperature detector falls to or below the third predetermined value.

8. The air conditioner of claim 2, wherein execution of the program further causes the processor to:

calculate an index indicating the load of the indoor space based on a difference between a set temperature for the indoor space and a detected air temperature in the heating operation in the airflow mode.

* * * * *